US005534881A

United States Patent [19]

Young et al.

[11] Patent Number: 5,534,881

[45] Date of Patent: Jul. 9, 1996

[54] MICROWAVE FILTER ASSEMBLY HAVING A NONSYMMETRICAL WAVEGUIDE AND AN ANTENNA

[75] Inventors: Frederick A. Young, Huntington Beach; Louis W. Hendrick, Hermosa Beach; Keith N. Loi, Rosemead, all of Calif.

[73] Assignee: Hughes Aircraft Company, Los Angeles, Calif.

[21] Appl. No.: 298,630

[22] Filed: Aug. 31, 1994

[51] Int. Cl.[6] ..... H01Q 3/30; H01P 1/207; H01P 1/213

[52] U.S. Cl. ..... 343/776; 333/135; 333/209

[58] Field of Search ..... 333/208, 209, 333/212, 227, 230, 231, 126, 128, 134, 135, 137; 343/776, 777, 778

[56] References Cited

U.S. PATENT DOCUMENTS

| | | | |
|---|---|---|---|
| 3,559,043 | 1/1971 | Hyde . | |
| 4,630,009 | 12/1986 | Tang | 333/28 R |
| 5,309,166 | 5/1994 | Collier et al. | 343/778 |

FOREIGN PATENT DOCUMENTS

| | | |
|---|---|---|
| 75498 | 3/1983 | European Pat. Off. . |
| 0492303 | 7/1992 | European Pat. Off. . |
| 155802 | 6/1988 | Japan . |

OTHER PUBLICATIONS

Labay, V. A., et al.; *IEEE Transactions on Microwave Theory and Techniques;* "CAD of T–Septum Waveguide Evanescent–Mode Filters"; vol. 41, No. 4; Apr. 1993; New York, U.S.; pp. 731–733.

*Primary Examiner*—Benny T. Lee
*Assistant Examiner*—David Vu
*Attorney, Agent, or Firm*—Elizabeth E. Leitereg; Terje Gudmestad; Wanda K. Denson-Low

[57] ABSTRACT

A microwave cavity filter (30, 30A) is formed of a section of waveguide (36, 114) terminated by end walls (38, 40, 44, 166, 168, 176) to form cavities (32, 34, 32A, 34A) wherein ridges (100, 102, 118, 120) are disposed longitudinally within a cavity and extend from the cavity wall partway to a central region (104, 124) of the cavity. In a preferred embodiment of the invention, the ridges are disposed symmetrically about a central plane (144), each ridge having a first component (106, 122) perpendicular to the central plane and a second component (108, 126) parallel to the central plane. A cross-sectional shape of a filter cavity may approximate a semicircle wherein one wall section (88, 130) of the filter cavity is disposed within a diametric plane (216) of the cavity. The end walls of the cavities may be constructed as iris plates with apertures (82, 182, 184, 186, 190) for coupling energy of selected modes of electromagnetic resonance within the respective cavities. Each cavity supports two orthogonal modes wherein, within the region, between the parallel second components of the two ridges, the electromagnetic fields of a first mode are parallel to the central plane and the electromagnetic fields of the second mode are perpendicular to the central plane. Mode coupling screws (80, 156) may be provided for coupling of energy between the modes within a cavity. The ridging of the waveguide sections of the cavity reduces the low frequency cut-off, thereby enabling the cavities to be constructed with smaller dimensions to facilitate their emplacement within satellite communication systems.

11 Claims, 11 Drawing Sheets

FIG. 19
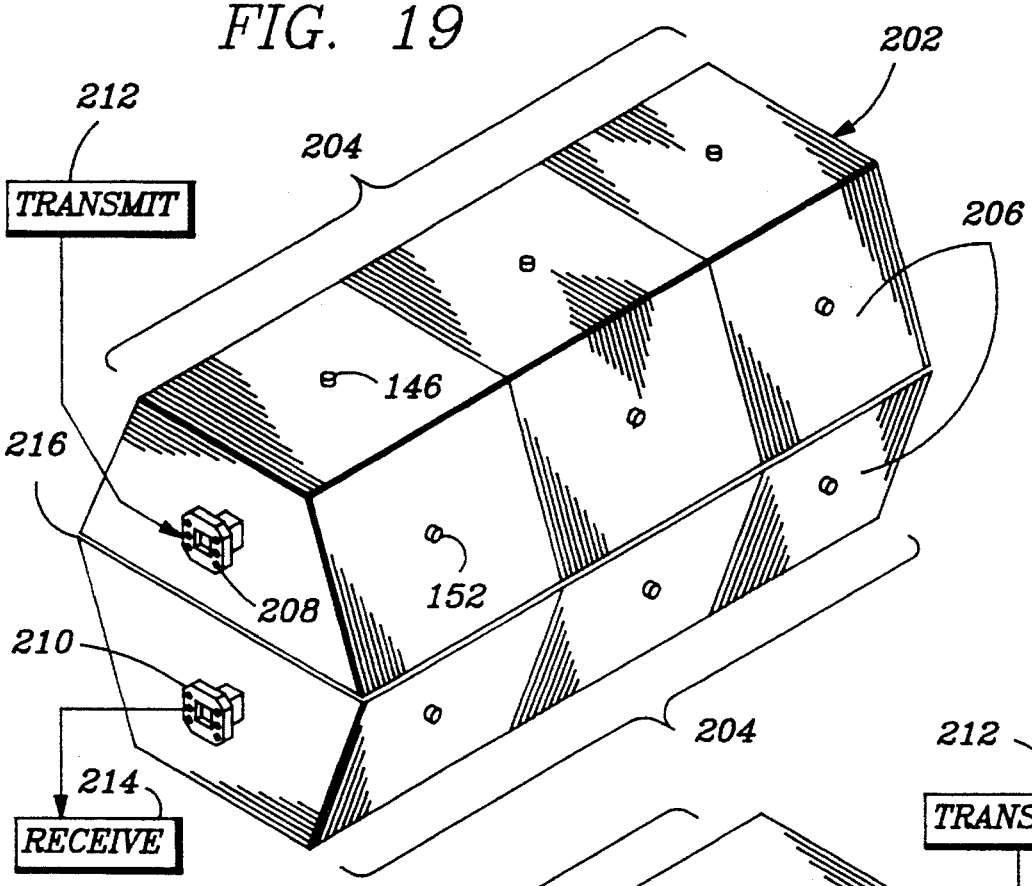
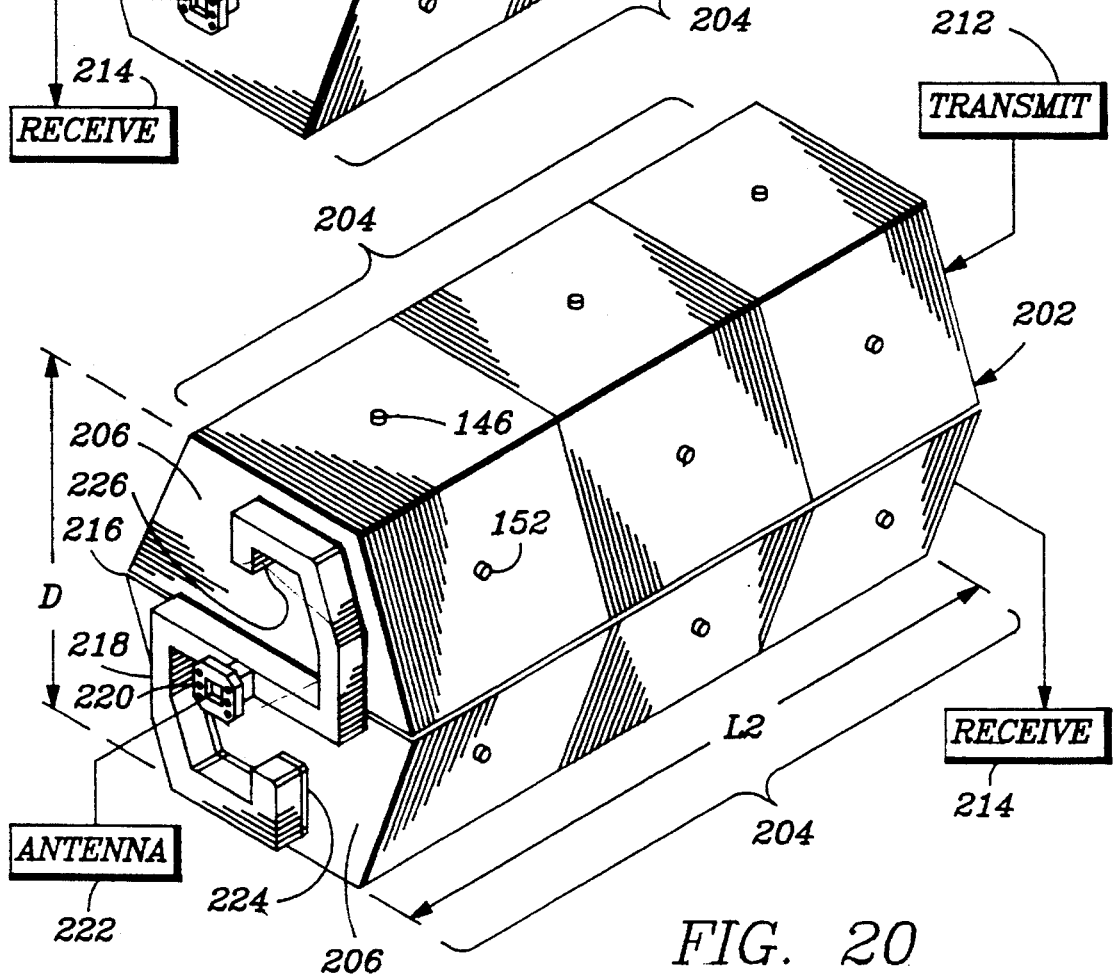
FIG. 20

MICROWAVE FILTER ASSEMBLY HAVING A NONSYMMETRICAL WAVEGUIDE AND AN ANTENNA

BACKGROUND OF THE INVENTION

This invention relates to cavity filters for filtering electromagnetic signals and, more particularly, to a filter constructed of a cavity having internal ridges which enable multiple mode operation of the filter and permit a reduction in the physical size of the cavity.

Microwave filters are employed in numerous signal processing situations ranging from satellite communication systems to radar systems. The use of microwave cavity filters in conjunction with a phased array antenna, carried by a satellite in a communication system, is of particular interest herein. Such filters may be employed to filter incoming and outgoing signals, and may be used in the construction of a diplexer.

The physical sizes of the cavities of such filters vary in accordance with the wavelength of the microwave signals to be filtered, with longer wavelength signals requiring larger cavities and shorter wavelength signals requiring smaller cavities. In the case of cavity filters carried by satellites, it is particularly important to reduce the overall size of the filter to facilitate the integration of the filter with other components of the satellite. A reduction on size can be accomplished by use of cavities operable with multiple modes of electromagnetic signals within the cavities. For example, a cavity of a filter operable in two orthogonal modes can produce the filter passband characteristics of a two-cavity filter with a single cavity.

However, a problem exists in that the foregoing reduction in filter size does not suffice for satellite systems operating at lower microwave frequencies such as L-band and S-band. The physical sizes of multiple pole filters having short cut-off passband characteristics, particularly in the situation wherein two such filters are employed in a diplexer connected to antenna elements, present substantial difficulty in packaging all of the microwave components within the region of space allocated for a phased array antenna.

SUMMARY OF THE INVENTION

The aforementioned problem is overcome and other advantages are provided by a microwave cavity filter having at least one cavity wherein, in accordance with the invention, each cavity is constructed as a waveguide section provided with interior ridges to resonate electromagnetic energy in a smaller volume housing. The ridging lowers the waveguide cut-off frequency and, hence, reduces the required size of the waveguide cavity as compared to a non-ridged waveguide operating at the same resonance frequency.

A feature of the invention is the construction of the waveguide section of a cavity with a cross-sectional shape substantially in a polygonal form having a generally semicircular footprint. This configuration of filter cavity is particularly advantageous for the construction of a diplexer having two cavity filters because the two filters can be mounted back to back along the common diametrical plane resulting in an overall cylindrical form to the diplexer. Diplexers may be employed with a phased array antenna wherein individual ones of the diplexers connect with respective radiating elements of the antenna. Due to the reduced physical size of each cavity filter, the diameter of the diplexer is smaller than a diameter of a corresponding radiating element of the phased array antenna, and can be mounted readily behind the radiating element.

In accordance with the theory of the invention, coupling between cavities, and between a cavity and an external waveguide or coaxial transmission line, can be accomplished by loops for coupling magnetic field components of electromagnetic waves or by irises for coupling electric field components of electromagnetic waves. In a preferred embodiment of the invention, the cavities are formed of ridged waveguide sections terminated by end of walls in the form of iris plates wherein an iris serves for the coupling of electromagnetic energy between contiguous cavities as well as between a cavity and an external waveguide.

The ridging in the preferred embodiment of the invention comprises a pair of planar horizontal elements parallel to the aforementioned diametric plane, and extending inwardly from the external cavity wall towards approximately the middle of a central plane which is perpendicular to the diametric plane. Each of the horizontal elements terminates at a location approximately two-thirds the distance to the central plane. The ridging further comprises a pair of vertical elements disposed at the inner end of the respective horizontal elements. The respective vertical elements are centered substantially at their respective junctions with the horizontal elements to provide T shape ridges in a preferred embodiment of the invention, though an L shape may also be employed as in an alternative embodiment of the invention. The vertical elements of the ridges extend through a distance approximately one-third to one-half of the distance between top and bottom walls of the waveguide section. The ridge elements extend the full length of a cavity and make electrical contact with the end walls.

Most of the electromagnetic energy stored in a cavity is present in the region between the two vertical elements of the ridging. The energy is stored on two orthogonal modes of electromagnetic waves. In a first of the modes, the electric field is vertical and is parallel to the vertical elements of the ridging within the aforementioned region between the vertical ridge elements. In a second of the modes, the electric field is horizontal and is perpendicular to the vertical ridge elements within the region between the vertical ridge elements. It is noted that the terms "horizontal" and "vertical" are provided to facilitate description of the filter structure, and do not require any specific directions relative to the earth's surface since the filter can be oriented in any desired direction.

The configuration of the filter cavity provides for a high Q (quality factor) resonance. Tuning screws are provided for interaction with individual ones of the modes for separately tuning the cavity to each mode. In addition, cross coupling elements, in the form of coupling screws, in the preferred embodiment of the invention, are provided for coupling energy between the first and the second modes. Irises in the iris plates are configured as slots oriented for preferential coupling of energy of a specific one of the modes between cavities and between an external waveguide and a cavity. Additional bridge coupling irises may be located in an iris plate for coupling a portion of the stored energy in the manner of a bypass path between selected resonance modes. Both forms of coupling may be employed to develop desired amplitude and phase characteristics of the filter transfer function between input and output ports of the filter.

BRIEF DESCRIPTION OF THE DRAWING

The aforementioned aspects and other features of the invention are explained in the following description, taken in connection with the accompanying drawing figures wherein:

FIG. 19 shows two filter assemblies of the form shown in either FIGS. 3 or 7 with the two assemblies mounted back to back along their respective base walls:

FIG. 20 shows two filter assemblies connected electrically as a diplexer and mounted back to back, as in FIG. 19, with portions of an antenna system being indicated diagrammatically;

Figure 1:
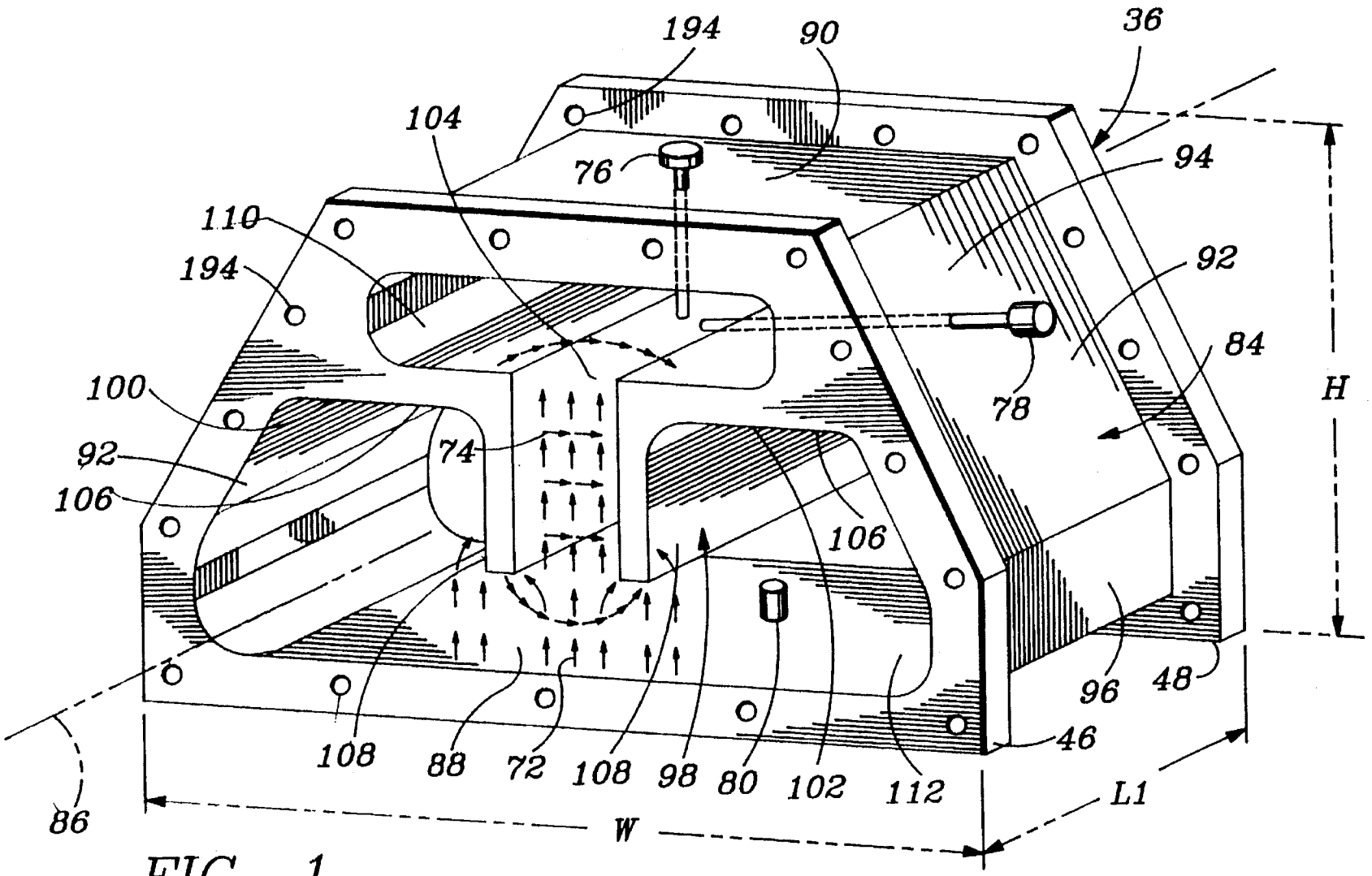
FIG. 1 is a stylized perspective view of a section of waveguide employed in the construction of a microwave cavity filter section of a filter of FIG. 3, the waveguide section including ridges each having an L shape.

Identically labeled elements appealing in different ones of the figures refer to the same element in the different figures.

DETAILED DESCRIPTION

With reference to FIGS. 1–4, a microwave filter assembly 30 (shown in FIG. 3) comprises a first filter cavity 32 and a second cavity 34. The cavity 32 comprises a waveguide section 36 terminated by a first end wall 38 and a second end wall 40. The second cavity 34 comprises a waveguide section 42 terminated by the second end wall 40 and a third end wall 44. The waveguide section 36 is provided with mounting flanges 46 and 48 for securing the waveguide section 36 to the first end wall 38 and the second end wall 40, the securing being accomplished by means of bolts 50 wherein only one of the bolts 50 is shown connecting with each of the flanges 46 and 48 to simplify the drawing. Similarly, the waveguide section 42 is provided with flanges 52 and 54 which connect, by bolts 50, respectively, to the end walls 40 and 44.

The first end wall 38 provides an input port 56 to the filter assembly 30, the input port 56 connecting with an electromagnetic transmission line which, by way of example, is depicted as a coaxial line 58. Alternatively, the transmission line may be a waveguide as will be described hereinafter with reference to an embodiment disclosed in FIG. 7. Various forms of coupling elements, such as will be disclosed with reference to FIGS. 11–18, may be employed, a coupling loop 60 being shown by way of example. The loop 60 protrudes into the waveguide section 36, and connects between an inner conductor 62 and an outer conductor 64 of the coaxial line 58. In similar fashion, the third end wall 44 provides an output port 66 to the filter assembly 30, the output port 66 being constructed in a fashion similar to that of the input port 56, and having a coupling loop 68 connecting with a coaxial line 70.

Each of the cavities 32 and 34 supports two modes of resonance of electromagnetic waves wherein, in a first mode, the electric field lines 72 (shown in FIG. 1) are vertical and in the second mode, the electric field lines 74 (also shown in FIG. 1) are horizontal within a central region of the waveguide section 36. The waveguide section 36 is provided with a first tuning screw 76 for interacting with the vertical field lines for tuning the first resonance mode, and a second tuning screw 78 for interaction with the horizontal field lines 74 for tuning the second resonance mode. Also provided in the waveguide section 36 is a means for coupling electromagnetic energy between the two modes of resonance, this coupling means being shown, by way of example, as a mode coupling screw 80. The second waveguide section 42 is provided similarly with tuning screws and a mode coupling screw, the screws having been deleted in FIG. 3 to simplify the drawing. The second end wall 40 is provided with a means for coupling electromagnetic energy between one or more modes of the first cavity 32 to a corresponding one or more modes of the second cavity 34. Such coupling can be accomplished by means of loops, probes or irises which may be configured and located for interaction with a specific mode or modes. Examples of irises will be described with reference to FIGS. 8–10. A further example is provided in FIGS. 3 and 4 wherein coupling of the electromagnetic power through the end wall 40 is provided by means of an iris 82 having a cross slotted shape for interaction with both the horizontally and the vertically directed field lines 72 and 74.

Figure 2:
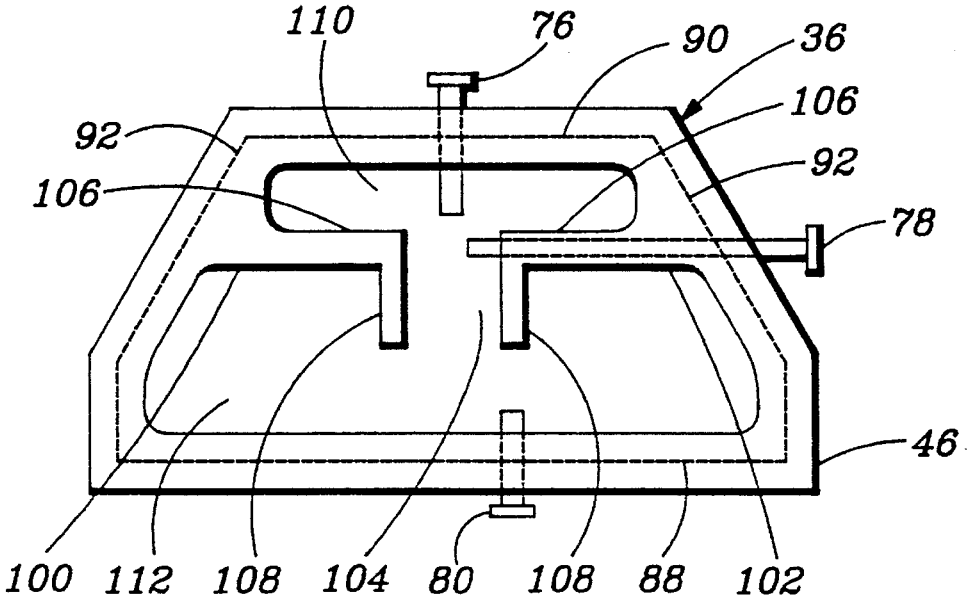
FIG. 2 is an end view of the waveguide section of FIG. 1.

In accordance with the invention, and as shown in FIGS. 1 and 2, the waveguide section 36 has an electrically conductive outer wall 84 encircling a longitudinal axis 86 of the waveguide section 36. The outer wall 84 is constructed of a plurality of wall segments which include a bottom wall 88, a top wall 90, and opposed sidewalls 92 each of which comprises an upper side wall segment 94 and a lower side wall segment 96. Each of the upper side wall segments 94 adjoin with the top wall 90, and each of the lower side wall segments 96 adjoin with the bottom wall 88. The outer wall 84 extends between the flanges 46 and 48. It is to be noted that the use of the terms top and bottom in describing the segments of the outer wall 84 are useful in describing the waveguide section 36, wherein the bottom wall 88 serves as a base upon which the waveguide section 36 stands (as depicted in FIG. 1). These terms do not represent any preferred orientation of the waveguide section 36 which, in operation, may have any desired orientation. In the cross sectional view of the waveguide section 36, taken in a plane transverse to the longitudinal axis 86, the segments of the outer wall 84 provide an approximation to a semicircle wherein the base, or bottom wall 88, of the waveguide section 36 lies in a diametrical plane of the semicircle, and wherein the top wall 90 in conjunction with the side wall segments 94 and 96 provide an approximation to the semicircular arc.

An important feature of the invention is the inclusion in the waveguide section 36 of a ridge assembly 98 comprising two L-shaped ridges 100 and 102. The ridges 100 and 102 extend inwardly from the upper sidewall segments 94 towards a central region 104 of the waveguide section 36. The ridges 100 and 102 extend for the full length of the waveguide section 36, as measured along the axis 86. Generally, the ridges 100 and 102 are to be fabricated as mirror images of each other, with each of the ridges 100 and 102 having a portion constructed as a horizontal leg 106 and a further portion constructed as a vertical plate 108.

Figure 3:
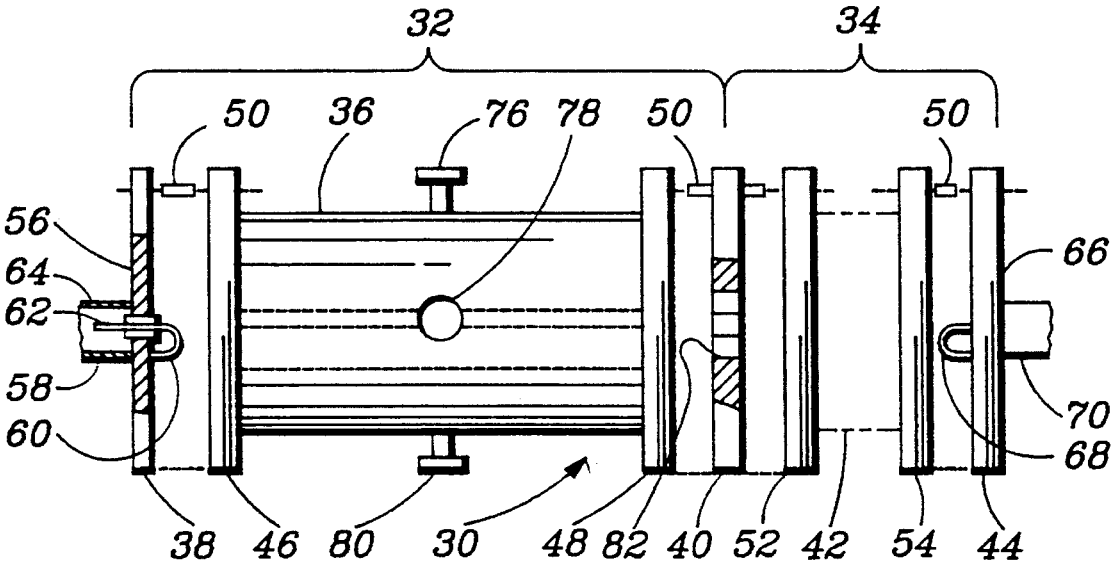
FIG. 3 is an exploded view of a filter assembly comprising two cavities, with portions of the figure being cut away to show hidden details.
Figure 4:
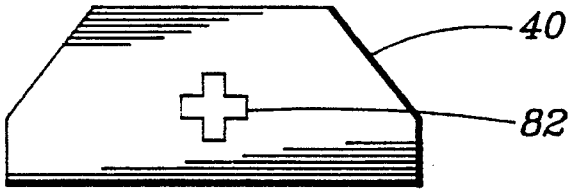
FIG. 4 is a plan view of an end wall of a cavity of FIG. 3, the end wall being constructed in the form of an iris plate.

Preferably, the horizontal legs 106 of the ridges 100 and 102 are coplanar, and the vertical plates 108 of the ridges 100 and 102 are parallel and spaced apart from each other to form the central region 104 of the waveguide section 36. The vertical dimension of each of the plates 108 is approximately one-half the interior vertical dimension, between the top and the bottom walls 90 and 88, of the waveguide section 36. The plates 108 are approximately equally spaced between the top wall 90 and the bottom wall 88. The configuration of the waveguide section 36, including its ridge assembly 98, provides within the cavity 32 (FIG. 3) an upper chamber 110 and a lower chamber 112 which communicate with each other via the central region 104. The volume of the upper chamber 110 is smaller than the volume of the lower chamber 112. It is noted that the waveguide section 42 of FIG. 3 is constructed in the same fashion as the waveguide section 36, and includes a ridge assembly and a geometrical configuration in accordance with that just described for the waveguide section 36. Accordingly, it is to be understood that the description provided above for the waveguide section 36 applies also to the waveguide section 42, and that the two waveguide sections 36 and 42 are arranged coaxially in the filter assembly 30 of FIG. 3.

FIGS. 1 and 2 also show the locations of the screws 76, 78, and 80 for interaction with the electric field lines 72 and 74 to accomplish a tuning of the cavity 32 (FIG. 3) and a coupling of electromagnetic energy between the resonance modes. The vertical field lines 72 extend from the bottom wall 88 towards the ridge assembly 98 and towards the top wall 90. The directions of the field lines 72 is diverted somewhat from the vertical plane in the vicinity of the plates 108, and is normal to the surface of the plates 108 at the points of interception of a field line with the plate surface. The field lines 72 are portrayed as being relatively long in those regions of the waveguide section 36 wherein the electric field is relatively strong, the field lines being shortened in regions wherein the electric field strength is relatively weak. With respect to the vertical electric field, since many of the field lines terminate on the plates 108, the intensity of the electric field is reduced with progression upwardly through the central region 104. As a result, and also because of the larger size of the lower chamber 112 as compared to the size of the upper chamber 110, there is relatively little stored energy of the vertical electric field within the upper chamber 110, with most of the stored energy appearing in the lower chamber 112.

The tuning screw 76, located in the top wall 90, extends downwardly towards the central region 104 in the vertical direction so as to be parallel to the field lines 72. This orientation of the tuning screw 76 relative to the field lines 72 enables interaction of the field lines 72 with the screw 76 for tuning a frequency of resonance of the electromagnetic wave having the electric field lines 72. The center line of the screw 76 is equidistant between the plates 108. It is noted that the location of the tuning screw 76 in the top wall 90 is presented by way of example and that, if desired, the tuning screw 76 may be located in the same vertical plane, but upstanding from the bottom wall 88. Such an orientation of the vertical tuning screw is not shown in FIGS. 1 and 2, in order to simplify the drawing; however, such a location of the vertical tuning screw is shown in the alternative embodiment of FIG. 6.

With reference to FIGS. 1 and 2, the horizontal electric field lines 74 extend from the plate 108 of the ridge 100 to the plate 108 of the ridge 102. The arrows representing the field lines 74 are drawn with a maximum length in the region 104 between the plates 108 to indicate that the horizontal field strength is greatest at this location. Both above and below the plates 108, the field lines 74 deviate from the horizontal attitude in order to terminate upon the surfaces of the ridges 100 and 102. The arrows are shown with a shorter length to indicate that the strength of the field lines 74 is reduced in the regions above and below the plates 108. The storage of electromagnetic energy in the field lines 74 is most intense in the central region 104 between the plates 108, and is reduced significantly in the upper and the lower chambers 110 and 112. More stored energy of the field lines 74 appears in the lower chamber 112 than in the upper chamber 110.

The tuning screw 78 passes through the leg 106 of the ridge 102 to interact with the horizontal field lines 74, the direction of the screw 78 being parallel to the field lines 74 to enable the interaction of the screw 78 with the field lines 74 to accomplish a tuning of the resonant frequency of the electromagnetic wave associated with the field lines 74. Passage of the screw 78 via the leg 106 facilitates entry of the screw 78 into the central region 104 while isolating the screw 78 from the electromagnetic fields within the waveguide section 36 between the plate 108 of the ridge 102 and the right side wall 92. The mode coupling screw 80 is located in the bottom wall 88 beneath the right hand plate in order to interact with both of the field lines 72 and. 74. It is noted that, due to the curvature of both of these field lines in the vicinity of the lower edge of the right plate, there are components of the electric field which are parallel to the mode coupling screw 80 so as to permit interaction of the screw with both of these field lines, thereby to accomplish a transfer of energy between the waveguide modes. It is noted that the location of the mode coupling screw 80 beneath the right plate 108 is provided by way of example and that, if desired, the mode coupling screw 80 may be located beneath the left plate 108. Such a location of the screw 80 has been deleted from FIGS. 1 and 2 in order to simplify the drawing, but is shown on the alternative embodiment of FIG. 6.

Figure 5:
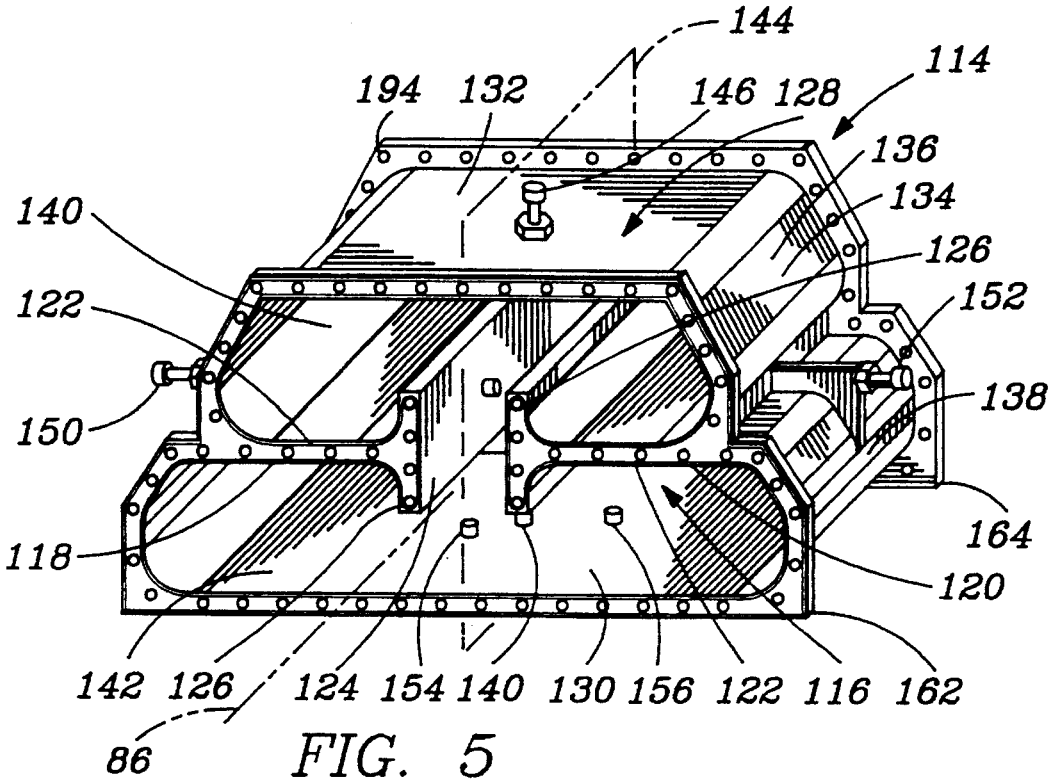
FIG. 5 is a view similar to that of FIG. 1 for an alternative embodiment of the waveguide section wherein the ridges have a T shape.
Figure 6:
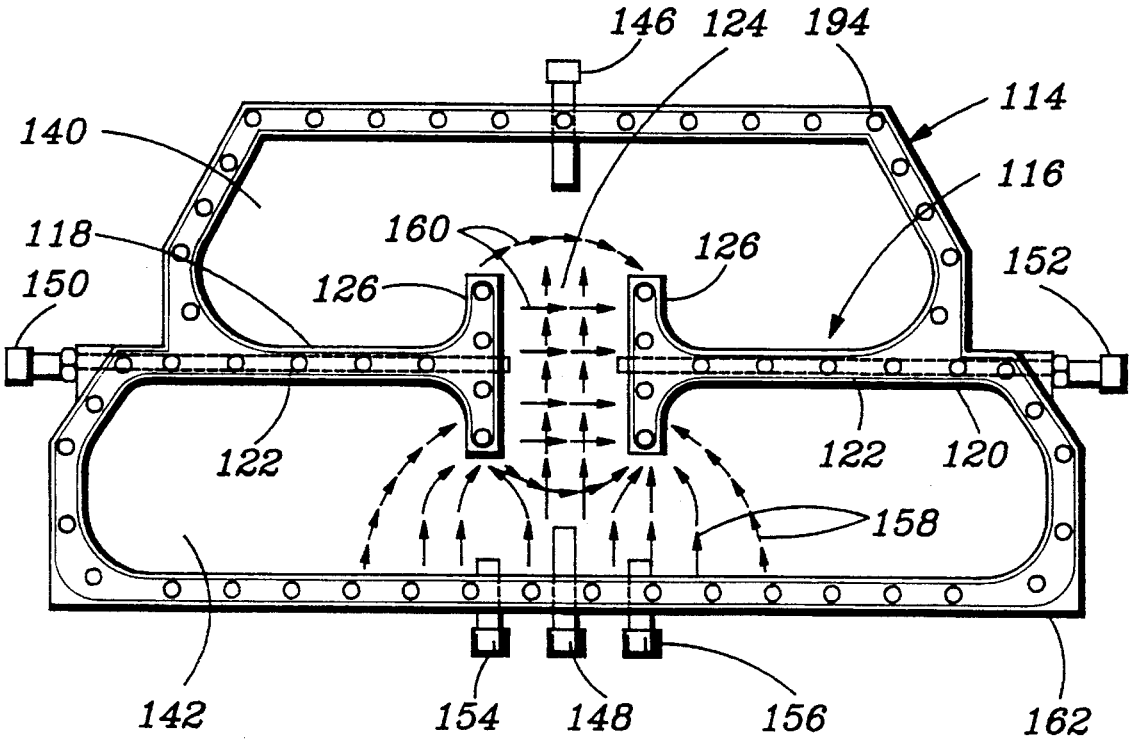
FIG. 6 is an end view of the waveguide section of FIG. 5.

FIGS. 5 and 6 show a waveguide section 114 of an alternative embodiment of the invention having a ridge assembly 116 comprising two ridges 118 and 120 which, in transverse cross section about the longitudinal axis 86, have a T shape. Each of the ridges 118 and 120 comprises a horizontal leg 122 which extends toward a central region 124, and terminate with a vertical plate 126. The plates 126 are parallel to each other and are spaced apart from each other to form the central region 124. The essential difference between the embodiment of FIGS. 5 and 6 and the embodiment of FIGS. 1 and 2 is that, in FIGS. 5 and 6, the waveguide section 114 employs T-shape ridges 118 and 120 while, in the embodiment of FIGS. 1 and 2, the waveguide section 36 employs L-shaped ridges 100 and 102. Otherwise, the waveguide section 114 has a general configuration which is similar to that of the waveguide section 36 of FIGS. 1 and 2. Thus, in FIGS. 5 and 6, the waveguide section 114 comprises an outer wall 128 encircling the central longitudinal axis 86. The outer wall 128 has a plurality of wall segments including a bottom wall 130, a top wall 132, and opposed side walls 134 which join the top wall 132 to the bottom wall 130. Each of the side walls 134 has an upper side wall segment 136 and a lower sidewall segment 138. The top wall 132 is parallel to the bottom wall 130, and the sidewall segments 136 and 138 produce, in cooperation with the top wall 132 the approximation to the semicircular configuration wherein the bottom wall 130 is located in a diametrical plane of the semicircular configuration. Thus, both the waveguide sections 36 and 114 have the shape of a right cylinder.

The horizontal legs 122 of the ridges 118 and 120 are located halfway between the top wall 132 and the bottom wall 130 to provide for an upper chamber 140 and a lower chamber 142 wherein the volume of the upper chamber 140 is smaller than the volume of the lower chamber 142 due to the inclination of the sidewalls 134=. The plates 126 are symmetrically located on opposite sides of a central vertical plane 144 which passes through the axis 86. The plates 126 extend in the vertical direction a distance equal approximately to one-third of the space between the top wall 132 and the bottom wall 130, and are centrally located between the top wall 132 and the bottom wall 130. The horizontal legs 122 of the ridges 118 and 120 are coplanar. The location of the horizontal legs 122 midway between the top wall 132 and the bottom wall 130 provides for a smaller difference in the volumes of the upper chamber 140 relative to the lower chamber 142 than occurs in the corresponding structure of the waveguide section 36 of FIGS. 1 and 2 wherein the horizontal legs 106 are located nearer to the top wall 90.

In FIGS. 5 and 6, the waveguide section 114 is provided with a plurality of vertical tuning screws 146 and 148, by way of example, and also a plurality of horizontal tuning screws 150 and 152, and a pair of mode coupling screws 154 and 156. The vertical tuning screws 146 are disposed along the central vertical plane 144, the horizontal tuning screws 150 and 152 pass through the horizontal legs 122 along a central horizontal plane, and the mode coupling screws 154 and 156 are located, respectively, beneath the left and the right plates 126.

Figure 7:
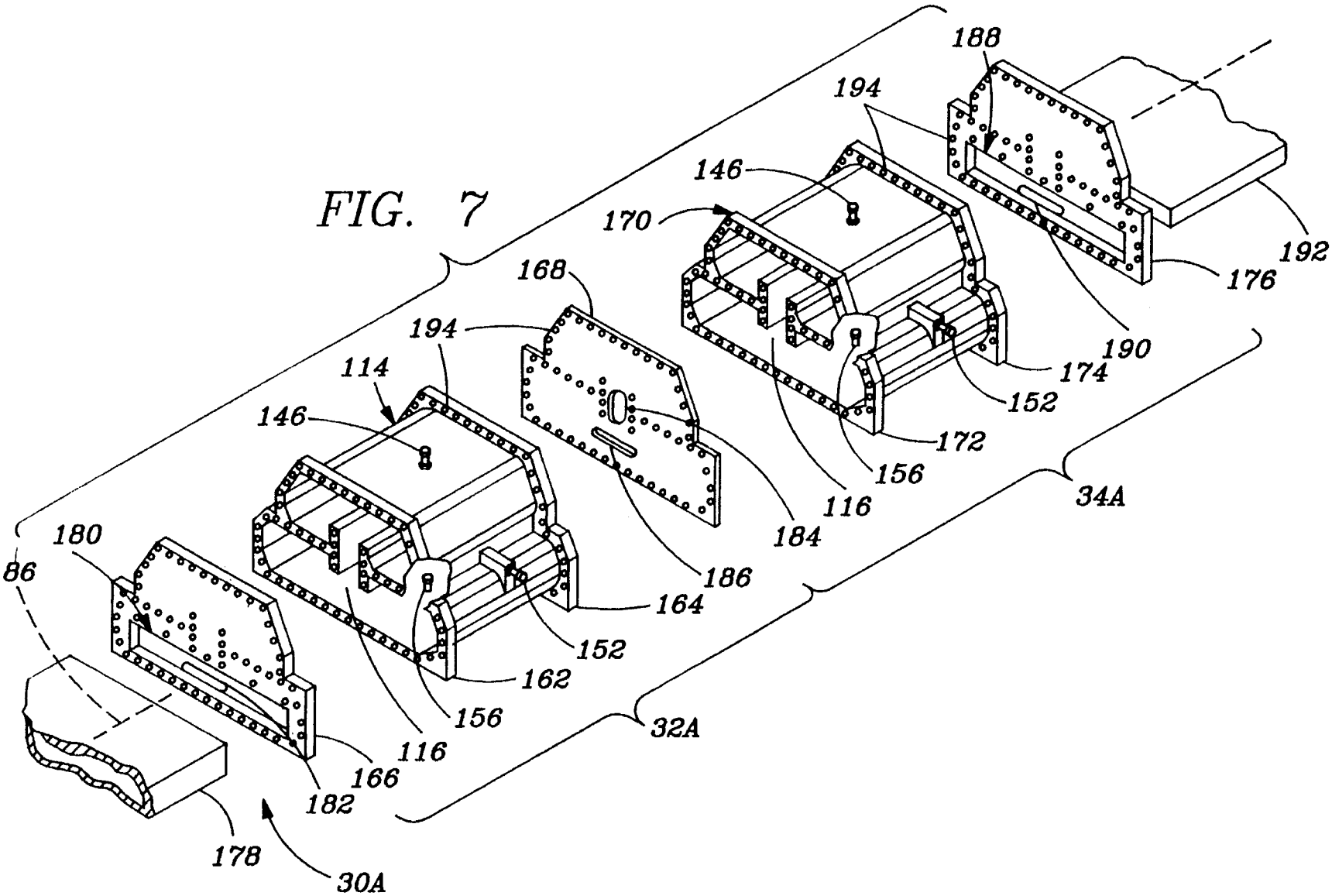
FIG. 7 is an exploded view of a filter assembly comprising two cavities having T-shaped ridges, with portions of the figure being cut away to show mode coupling screws.

Vertical field lines 158 and horizontal field lines 160 are presented to show the electric fields of the two modes of resonance of the electromagnetic waves within a cavity 32A, to be described in FIG. 7. It is observed, by comparison of FIGS. 1 and 6, that the general arrangement of the field lines 158 and 160 follows that of the field lines 72 and 74. Furthermore, the locations of higher intensities and lower intensities of the electric fields, represented by the lines 158 and 160, are essentially the same as the locations described above by the field lines 72 and 74. In the waveguide section 114, most of the stored energy of both of the electromagnetic modes is found in the lower larger chamber 142 with a reduced amount of energy storage being found in the smaller upper chamber 140.

The vertical orientation of the screws 146 and 148 permits interaction with the vertical field lines 158 and the horizontal orientation of the screws 150 and 152 permits interaction with the horizontal field lines 160. Also, with respect to the mode coupling screws 154 and 156, the locations beneath the plates 126 permits interaction with both of the field lines 158 and 160 due to the curvature of these lines, thereby to permit coupling of energy between two modes of electromagnetic resonance. With respect to the tuning of the vertical mode, either the screw 146 or the screw 148 or both of these screws may be employed as may be convenient in the tuning. Similarly, with respect to the tuning of the horizontal modes, either the screw 150 or the screw 152 or both of these screws may be employed for the tuning, as may be convenient. And, in similar fashion, with respect to the mode coupling, either the screw 154 or the screw 156 or both of these screws 154 and 156 may be employed for adjusting the coupling of energy between the two modes. In both the embodiments of the waveguide section 36 and the waveguide section 114, the tuning and mode coupling screws are positioned similarly with respect to a transverse plane of the respective waveguide sections. Thus, in the waveguide section 36, the screws 76, 78, and 80 are located in a transverse plane equidistant between the flanges 46 and 48. The waveguide section 114 is also provided with flanges 162 and 164, and the screws 146, 148, 150, 152, 154, and 156 are located in a transverse plan equidistant between the flanges 162 and 164.

FIG. 7 shows a filter assembly 30A comprising two cavities 32A and 34A. The filter assembly 30A is similar to that of the filter assembly 30 of FIG. 3 except that the cavities 32A and 34A employ the waveguide section 114 of FIGS. 5 and 6 while, in FIG. 3, the cavities 32 and 34 of filter assembly 30 comprise the waveguide section 36 of FIGS. 1 and 2. In FIG. 7, the cavity 32A comprises the waveguide section 114, a first end wall 166 connected to a front end of the waveguide section 114 by the flanges 162, and a second end wall 168 connected to a back end of the waveguide section 114 by the flanges 164. Connection is made by way of bolts (not shown). The cavity 34A comprises a further waveguide section 170 constructed in the same fashion as the waveguide section 114, and having flanges 172 and 174. The cavity 34A further comprises the second end wall 168 which connects to the front end of the waveguide section 170 by means of the flange 172 and a third end wall 176 which connects to a back end of the waveguide 170 by means of the flanges 174. Each of the waveguide sections 114 and 170 comprise the ridge assembly 116, FIG. 7 showing also three of the screws for each of the waveguide sections 114 and 170, namely, the vertical tuning screw 146, the horizontal tuning screw 152, and the mode coupling screw 156. Portions of the waveguide sections 114 and 170 are cut away to show the mode coupling screws 156.

Input power to the filter assembly 30A is provided by a waveguide 178 constructed as a half height waveguide, with type WR510 being employed in the preferred embodiment of the invention. The first end wall 166 includes an iris plate 180 which abuts the end of the waveguide 178 and serves as an end wall thereof. The iris plate 180 includes an iris 182 formed as a slot elongated in the horizontal direction and centered on the vertical plane 144 (shown in FIG. 5). The iris 182 couples power from a vertically oriented electric field within the waveguide 178 to excite the vertical mode of vibration represented by the field lines 158 (FIG. 6) in the cavity 32A. The second end wall 168 is configured as an iris plate and includes a main coupling iris 184 and a bridge coupling iris 186. The main coupling iris 184 is a slot elongated in the vertical direction for coupling energy between the horizontally directed electric field of the cavity 32A to the horizontally directed field of the cavity 34A. The iris 184 is aligned with the central region 124 (shown in FIGS. 5 and 6). The bridge coupling iris 186 is a slot elongated in the horizontal direction for coupling a relatively small amount of energy between the vertically oriented field of the cavity 32A and the vertically oriented field of the cavity 34A. The iris 186 is centered approximately at the location of the central vertical plane 144 (shown in FIG. 5). The iris 186 is located below the plates 126 of the ridges 118 and 120 (identified in FIGS. 5 and 6). The third end wall 176 is configured in a manner similar to that of the first end wall 166 and includes an iris plate 188 having an iris 190. The iris 190 is located beneath the central section of the waveguide section 170 and centered along the plane 144 (shown in FIG. 5), and serves to couple a vertically directed electric field from the cavity 34A to an output waveguide 192. The waveguide 192 has the same configuration as the waveguide 178.

In operation, an electromagnetic field with the electric field polarized in the vertical direction is coupled from the waveguide 178 via the iris 182 to establish the first mode of resonance in the cavity 32A wherein the electric field is vertical. By virtue of a mode coupling screw, such as the screw 156, energy is coupled from the first mode to the second mode of resonance wherein the electric field is horizontal. Then, by action of the iris 184 which is operative with the horizontally polarized electric field, energy is coupled between the second mode of resonance in the cavity 32A to the horizontal field lines of the second mode in the cavity 34A. Then, by means of a mode coupling screw, such as the screw 156, energy from the second mode of resonance is coupled to the first mode having the vertically polarized electric field. This is followed by a coupling of energy from the vertically polarized electric field via the slot 190 for outputting power from the filter assembly 30A into the output waveguide 192.

The filter transfer function is dependent on the specific frequencies to which the modes are tuned by the screws 146 and 152 in each of the cavities 32A and 34A, as well as on the amount of coupling of the horizontal electric field via the main coupling iris 184 as well as the amount of the coupling of the vertically directed electric field via the bridge coupling iris 186 between the cavities 32A and 34A. Due to the two modes of resonance within each of the cavities 32A and 34A, a filter composed of only one of the cavities would have a two-pole response, a filter assembly having the two cavities would have a four-pole response, with additional pairs of poles being provided by additional cavities (not shown in FIG. 7) which may be added to the filter assembly 30A.

With respect to the securing of the end walls and waveguide sections of the filter assembly 30A of FIG. 7, as well as of the filter assembly 30 of FIG. 3, the use of bolts 50 (FIG. 3) secures the foregoing components of the filter assembly by means of the flanges 162, 164, 172, and 174 of FIG. 7, and the corresponding flanges 46, 48, 52, and 54 of FIG. 3. Accordingly, bolt holes 194 are provided in the flanges and in the end walls, the bolt holes 194 being shown in FIGS. 1, 5, 6, and 7. It is desirable also to secure the ridges 118 and 120 of the ridge assembly 116 to the respective end walls, such as the end walls 166 and 168 of the cavities 32A at the interface between each of the ridges and an end wall. This may be accomplished by use of additional bolts or by welding in the case of a single cavity filter. In the case of a two cavity filter, welding may be employed or, alternatively, the bolt holes 194 directed in the longitudinal direction of the ridges 118 and 120 may extend completely through the ridges so as to permit use of a long-stem screwdriver to reach through and tighten the bolts. Alternatively, due to the rigidity of the ridges, the interfacing surfaces of the ridges may be roughened so that, upon a tightening of the bolts around the perimeter of the respective flange, pressure along the axial direction of the filter assembly forces the ridges to seat within the material of the end walls and make good electrical contact at the interfacing surfaces. It is to be emphasized that the filter assembly is operative even without such additional provision of electrical contact between the ridge assembly and an end wall, but that optimum performance is obtainable with the provision of the additional electrical contact.

Figure 8:
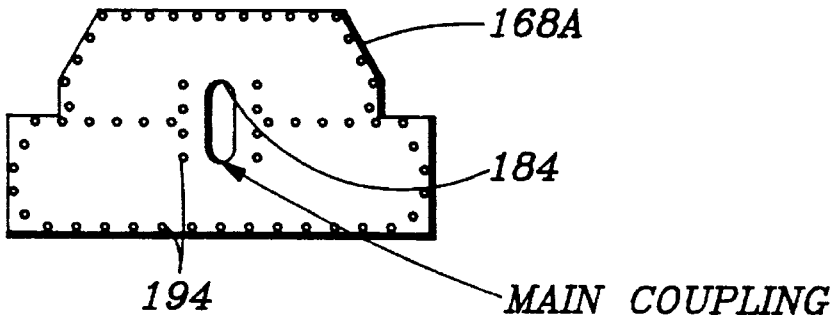
FIGS. 8, 9 and 10 are alternative embodiments of iris plates which serves as end walls of the cavities of the assembly of FIG. 7 and serve to couple electromagnetic energy between contiguous cavities.
Figure 9:
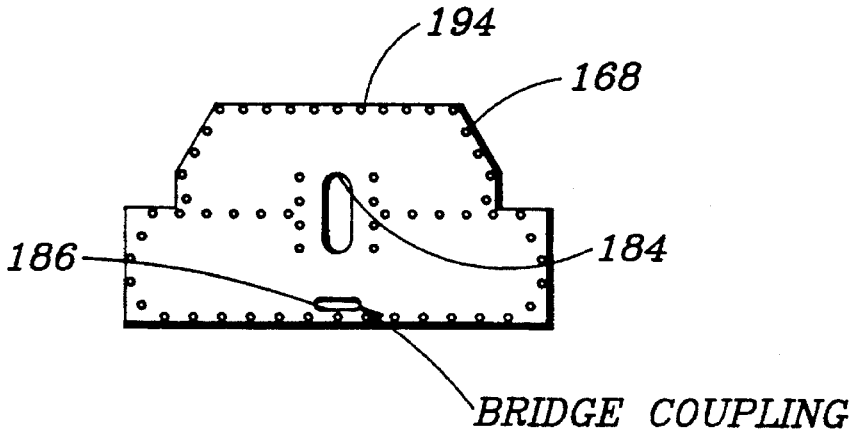
Figure 10:
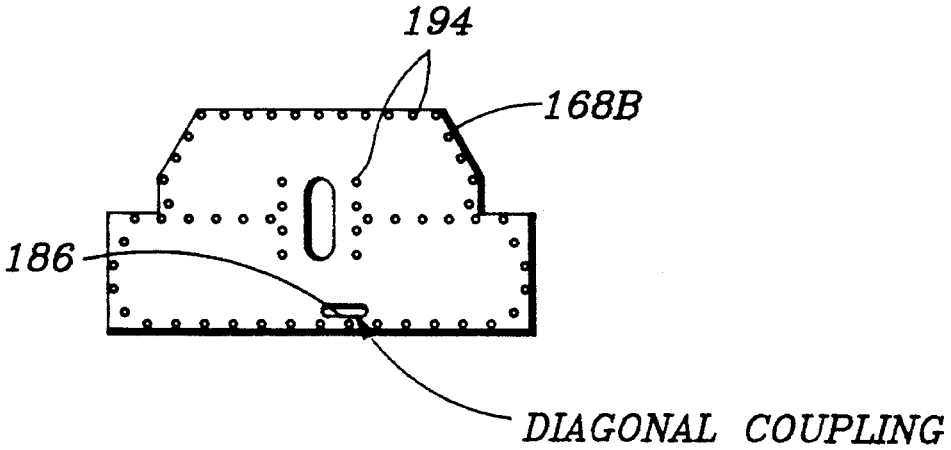

FIGS. 8, 9, and 10 show alternative configurations of the end wall 168. FIG. 9 shows a plan view of the end wall 168 with the irises 184 and 186 located as described hereinabove in the description of the filter assembly 30A of FIG. 7. FIG. 8 shows an end wall 168A which differs from the end wall 168 by deletion of the bridge coupling iris 186. FIG. 10 shows an end wall 168B which is a further modification of the end wall 168 wherein the iris 186 is moved to the right to be in alignment with the longitudinal vertical plane of the mode coupling screw 156 (FIGS. 5 and 6). As can be seen by the arrangement of the bolt holes 194 in FIG. 10, the iris 186 is located beneath the right hand plate 126 (shown in FIGS. 5 and 6). The translation of the iris 186 in the horizontal direction enables one to tailor the filter transfer function, as by moving the zero of the transmission characteristic, thereby to attain a desired filter response.

Figure 12:
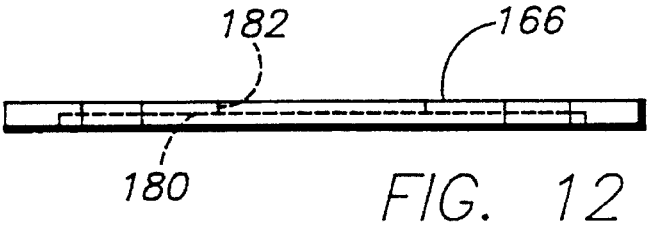
FIGS. 11–18 show cavity end walls with various types of coupling devices, with FIGS. 11, 13, 15 and 17 showing plan views of the walls and FIGS. 12, 14, 16 and 18 showing end views of the walls, with the walls being provided respectively with a waveguide and iris, a coaxial transmission line probe, a coaxial transmission line terminating with a loop in a vertical plane, and a coaxial transmission line terminating in a loop in a horizontal plane.
Figure 11:
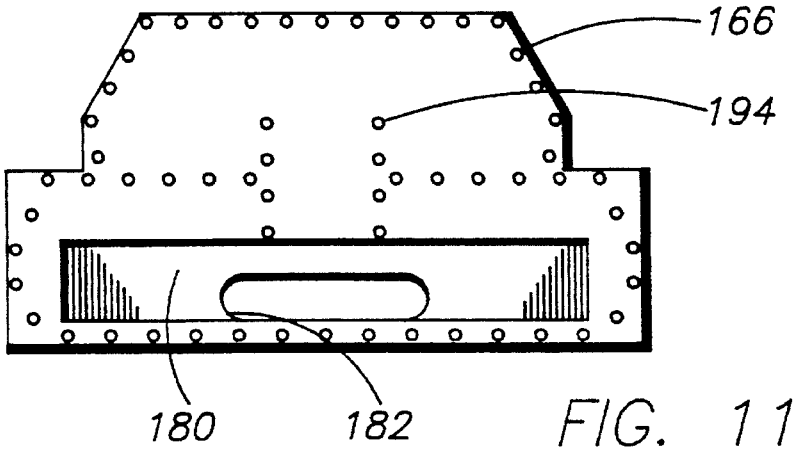
Figure 14:
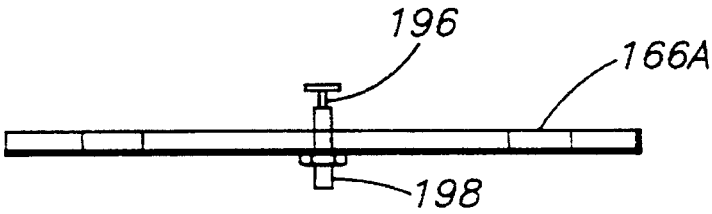
Figure 13:
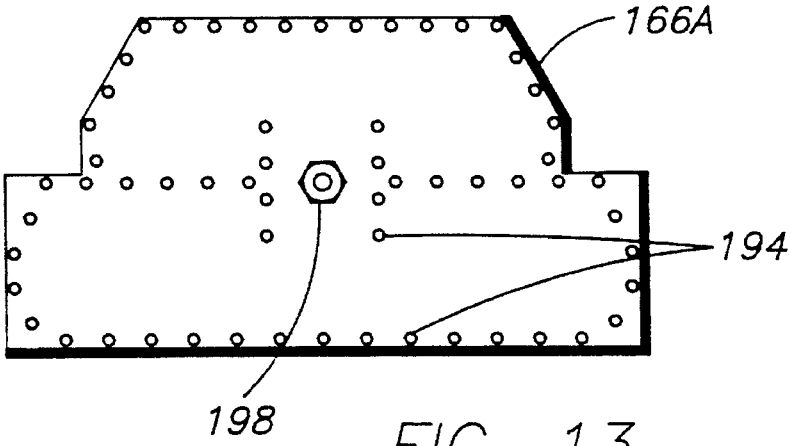

FIGS. 11–18 show various configurations which may be employed in the construction of the end wall 166 of FIG. 7. FIG. 1 shows a plan view of the end wall 166 and FIG. 12 shows a top view of the end wall 166, in accordance with the construction of the end wall 166 disclosed in FIG. 7. FIGS. 13 and 14 show an end wall 166A which differs from the wall 166 in that the iris plate 180 and the iris 182 have been replaced, in FIGS. 13 and 14, with a probe 196 connected to a coaxial line 198 . The coaxial line 198 is utilized instead of the waveguide 178 (FIG. 7). Thus, the end wall 166A is suitable for coupling power into the cavity 32A from a coaxial line in contradistinction to the end wall 166 which is configured for coupling power from a waveguide. By way of example, FIG. 13 shows the coaxial line 198 located in a central region between the plates 126 (FIG. 6) as is indicated by the arrangement of the bolt holes 194 positioned for connection with the ridges 118 and 120 (also shown in FIG. 6).

Figure 15:
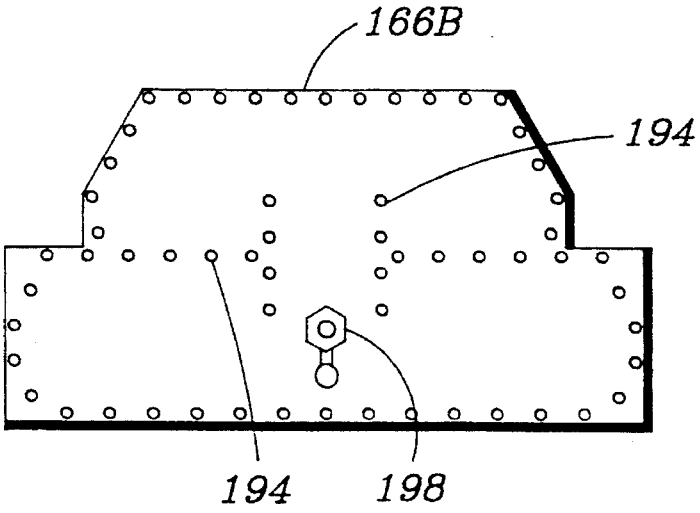
Figure 16:
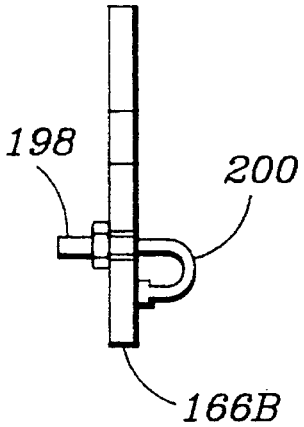
Figure 18:
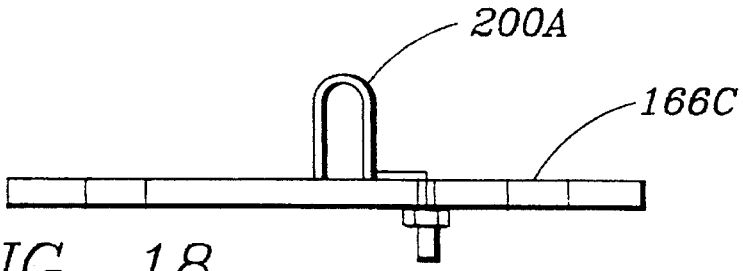
Figure 17:
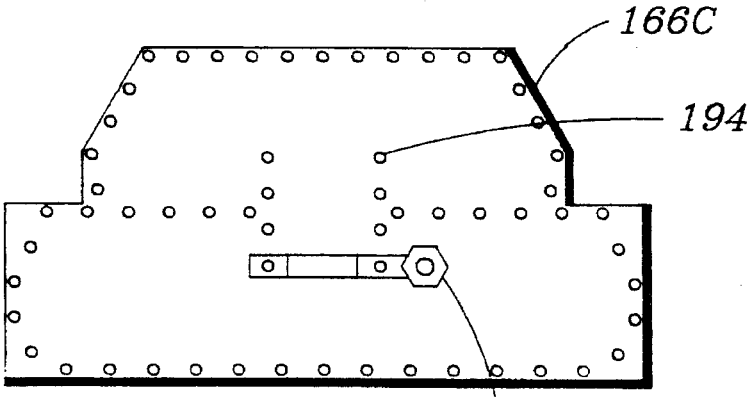

FIGS. 15 and 16 show plan and side views of an end wall 166B which represents a further embodiment of the end wall 166 suitable for coupling power from a coaxial line 198, but wherein the power is extracted by means of a loop 200 which is insulated so as to make contact only with the central conductor of the coaxial line 198 while the outer end of the loop 200 makes electrical contact with the metal of the end wall 166B. FIGS. 17 and 18 show plan and top views of a end wall 166C which also provides for the coupling of electromagnetic power from a coaxial line 198 external to the cavity 32A (FIG. 7) and a loop 200A which extends into the cavity 32A. In the wall 166B, the loop 200 is disposed in a vertical plane near the bottom central portion of the wall for inducing a magnetic field perpendicular to the vertical electric field. In the wall 166C, the loop 200A is oriented in a horizontal plane for providing a vertical magnetic field that couples with the horizontal electric field within the cavity 32A. By way of example, the loop 200A is positioned at a lower portion of the central region between the plates 126 (FIG. 6) as may be noted by reference to the arrangement of the bolt holes 194. Thus, in the embodiments of FIGS. 13–18, there is some form of electromagnetic coupling structure intruding into the cavity 32A, while with the embodiments of FIGS. 11–12, the interior wall surface is flush with the plane of the wall.

FIGS. 19 and 20 show perspective views in stylized fashion of a diplexer 202 composed of two filter assemblies 204, wherein each filter assembly 204 is composed of a set of serially connected microwave cavities 206. Each cavity 206 has the form of either the cavity 32 of FIGS. 1 and 2 or the cavity 32A of FIG. 7. By way of example, each of the filter assemblies 204 comprises three of the cavities 206. The filter assemblies 204 are mounted back to back along the common plane of bases, or bottom walls of the cavities 206 to provide for a physical configuration wherein the approximately semicircular configuration of each filter assembly 204 provides for a configuration of the diplexer 202 which is approximately circular. The view shown in FIGS. 19 and 20 are simplified to show the cavity side walls as being planar, this giving the simplified appearance of a right hexagonal cylinder to the diplexer 202.

Waveguide ports 208 and 210 are provided at the end of each filter assembly 204 for connection respectively with a transmitter 212 and a receiver 214. The common diametric plane upon which the bottom walls of the respective cavities 206 mate is indicated at 216. At the opposite ends of the two filter assemblies 204, there is a provision of a square-shaped coaxial transmission line 218 which is bifurcated at a port 22.0 for connection to an antenna 222. The coaxial line 218 connects microwave power from the antenna 22 to an input port 224 of the receiving filter assembly 204 and also connects the antenna 222 with an output port 226 of the transmitting filter assembly 204 by which microwave power passes to the antenna 222.

Figure 21:
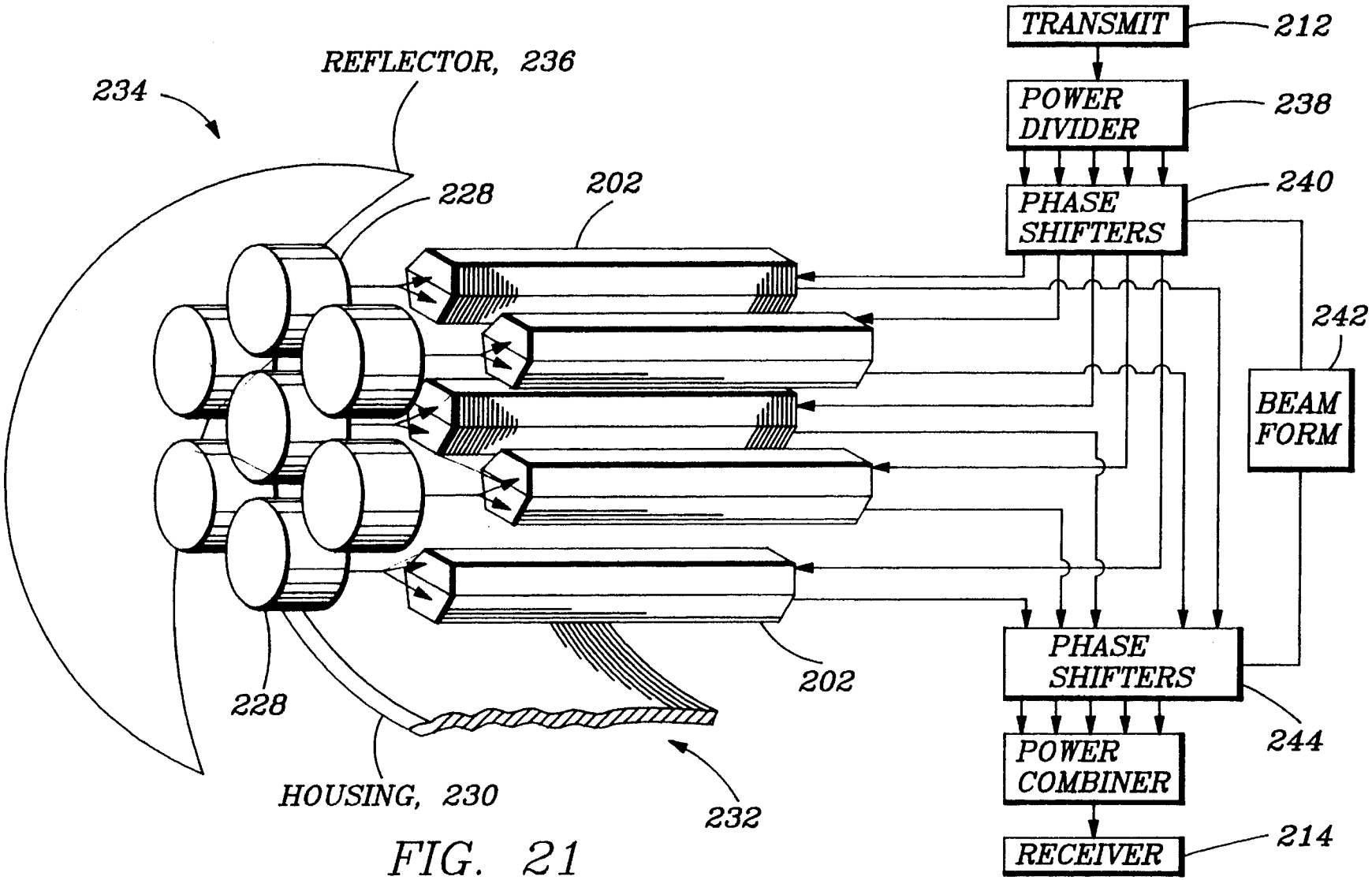
FIG. 21 shows a stylized view of an antenna feed for a phased array antenna including diplexers connected to the respective radiating elements as Shown in FIG. 20.

FIG. 21 demonstrates how the diameter of a diplexer 202 (FIGS. 19–20) is slightly less than the diameter of a radiating element 228 to permit the inclusion of the diplexers 202 within a common housing 230 of an antenna feed 232. In FIG. 21, a phased array antenna 234 includes an array of the radiating elements 228 disposed in the housing 230 along with the diplexers 202. The antenna 234 may also comprise a reflector 236 to aid in shaping a beam provided by the array of the radiating elements 228. Connection between the radiating elements 228 and the respective diplexers 202 is indicated diagrammatically and is accomplished in the manner disclosed in FIGS. 19 and 20. Power from the transmitter 212 is divided among the signal channels of the respective diplexers 202 by a power divider 238. The signals on the respective channels are provided with phase shift by a bank of phase shifters 240 under control of a beam former 242 to generate a beam to be transmitted from the antenna 234. In similar fashion, a receiving beam from the antenna is generated by means of a second bank of phase shifters 244 also operating under control of the beam former 242. Output signals of the phase shifters 244 are combined by a power combiner 246 and applied to the receiver 214. FIG. 21 demonstrates a major advantage of the invention in the packaging of the components of a phased array antenna. In particular, it is noted that the compact packaging permits deployment of such an antenna aboard a satellite in a satellite communication system.

Figure 22:
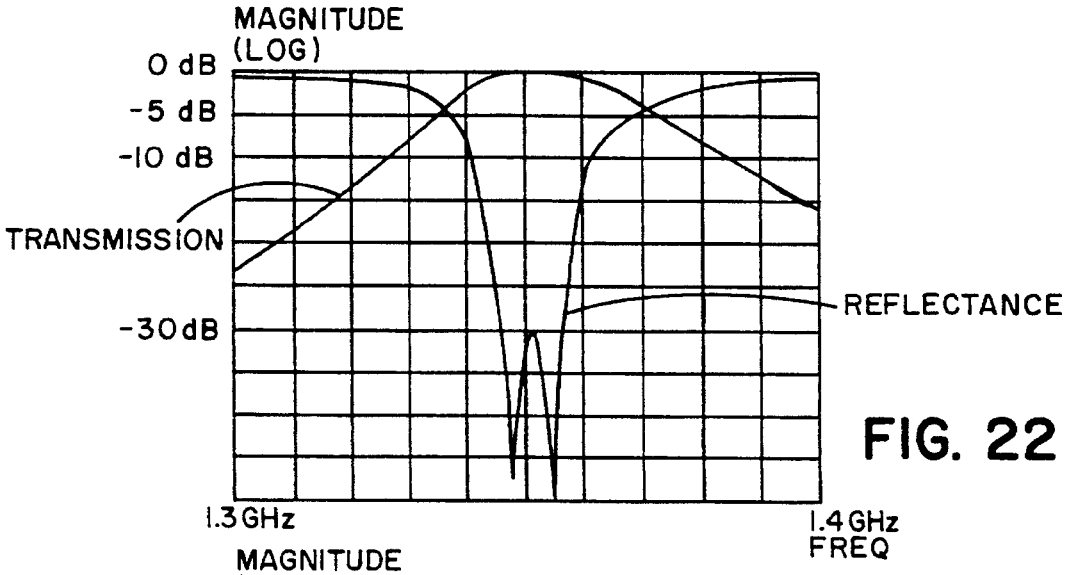
FIGS. 22–25 are graphs showing transmittance and reflectance (return loss) for different configurations of filter assembly wherein FIG. 22 pertains to a single cavity without bridge coupling, FIG. 23 pertains to a single cavity with bridge coupling, FIG. 24 pertains to a double cavity without bridge coupling, and FIG. 25 pertains to a double cavity with bridge coupling.
Figure 23:
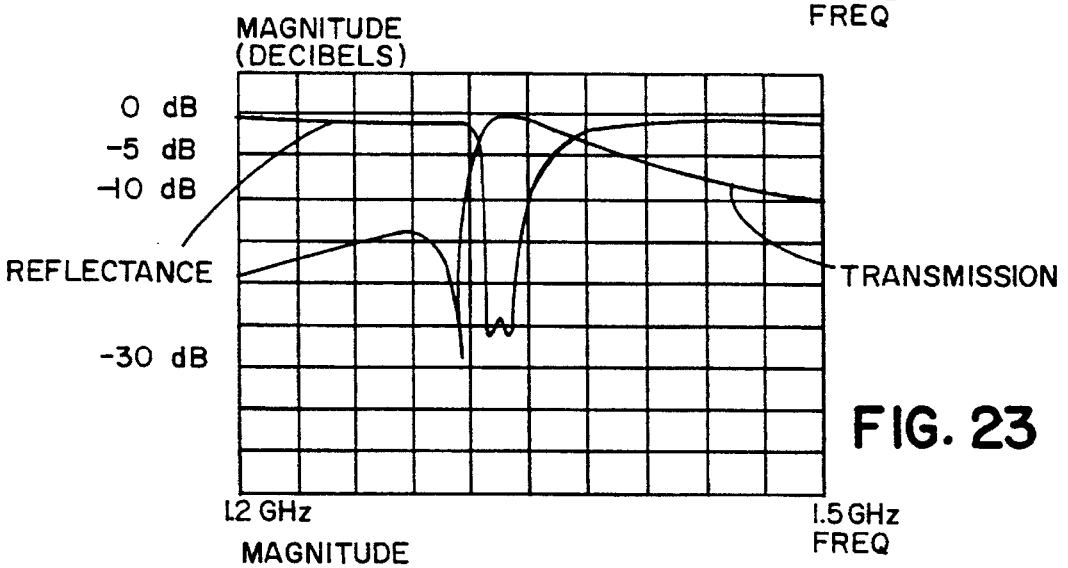
Figure 24:
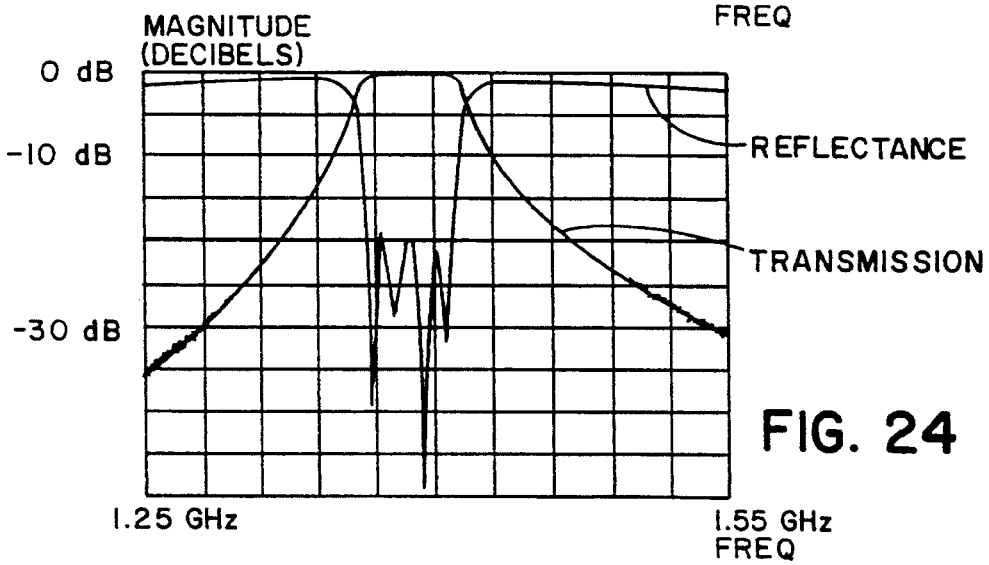
Figure 25:
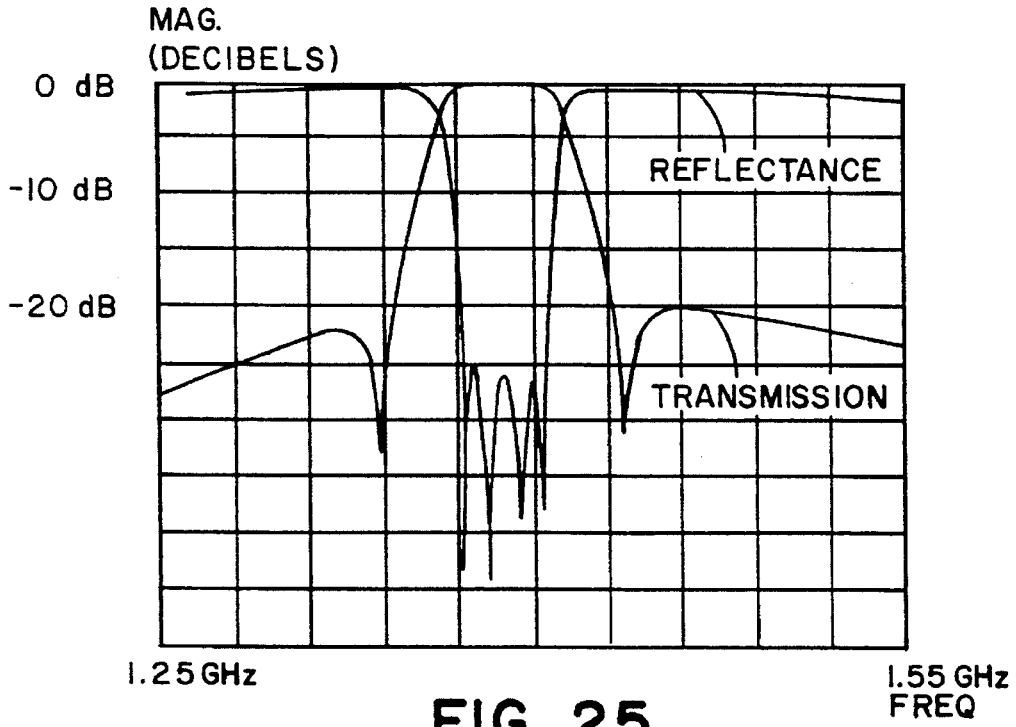

FIGS. 22–25 provide examples of transfer characteristics of a filter assembly having only one cavity (FIGS. 22 and 23) or two cavities (FIGS. 24 and 25). The cavities have been constructed in accordance with ridged waveguide sections constructed as shown in FIGS. 1 and 2 with end walls constructed as shown in FIG. 7. In the single cavity filter situation of FIG. 22, wherein the two modes of resonance are present, the graph shows the transmission characteristic and the reflectance characteristic for the situation in which there is no bridge coupling. The transmission characteristic is obtained by comparing input and output signals of the filter, and the reflectance characteristic is determined by the use of a hybrid circuit at the input terminal of the filter for measuring the intensities of a transmitted signal and a signal reflected back from the input port of the filter. Both the transmission and the reflectance, or return loss, is shown as amplitude versus frequency. The amplitude is presented in a logarithmic scale of the vertical axis of the graph, and the frequency is shown along the horizontal axis of the graph.

Figure 26:
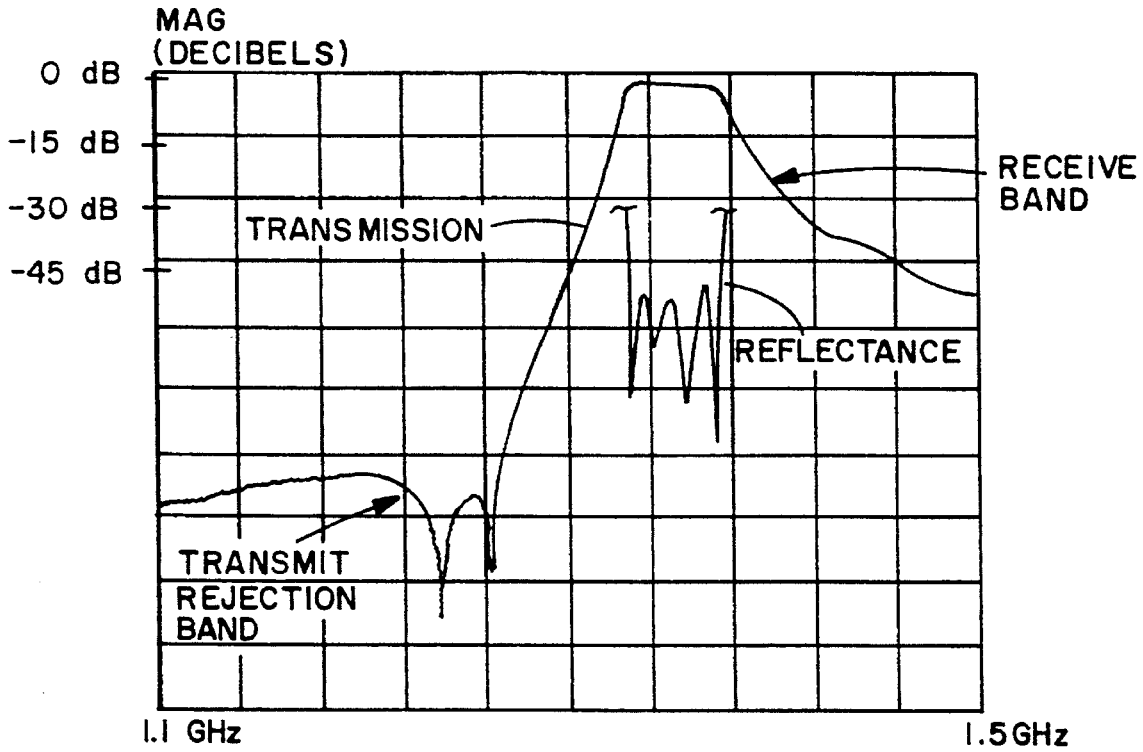
FIG. 26 is a graph showing a transmission characteristic for the two-cavity filter of FIG. 25, wherein the filter is tuned to have transmission zeros on one side of its transmission passband.

FIG. 22 shows that, in the central portion of the transmission spectrum wherein essentially all of the power is transmitted through the filter, there is no more than a negligible amount of reflected power from the input port of the filter. FIG. 23 shows the corresponding single cavity situation wherein a bridge coupling is also employed within the single filter cavity. The results are similar except that a zero from the transmission response has been moved from infinity to a region near the passband, this providing for a deep skirt on one side of the transmission band. Both FIGS. 22 and 23 present a situation of a two-pole filter response provided by the two modes of resonance within the single cavity. FIG. 24 corresponds to FIG. 22 for the two-cavity filter, and FIG. 25 corresponds to FIG. 23 for presenting the response for the two-cavity filter. FIGS. 24 and 25 present the four-pole resonance characteristic. Also, in FIG. 25, the bridge coupling is effective to move transmission zeros from infinity to both sides of the filter passband providing for a deep skirt on both sides of the passband. FIG. 26 shows the transmission characteristic for the two-cavity filter situation of FIG. 25, but wherein the filter has been tuned to move both of the transmission zeros to one side of the transmission passband. The result is a much steeper slope to the transmission passband than is obtained for the situation depicted in FIG. 25, the steeper slope being most useful in separating receive and transmit channels in a diplexer. By way of example in the tuning of the filter for the situation of FIG. 26, the transmission characteristic is provided for the receive channel of a diplexer, wherein the receive passband is indicated in the graph, and wherein the rejection band which corresponds to the transmission band of the transmit channel is also indicated in the graph.

Also, for reference, a portion of the reflectance characteristic of the two-cavity filter is shown also in FIG. 26. Thus, FIGS. 22–26 demonstrate the flexibility of the filter construction of the invention for providing a desired frequency characteristic.

The following dimensions of filter components described above are useful in appreciating the advantages of the invention over the prior art in decreasing the size of a filter assembly. At a frequency 1.5 GHz (gigahertz) the waveguide section 36 of FIG. 1 has the following approximate dimensions, namely, a width W=6.5 inches, an axial length L1=4.5 inches, and a height H=3.5 inches wherein the dimensions W. L1, and H are identified in FIG. 1. The corresponding approximate dimensions for the diplexer 202 of FIG. 20 are an axial length L2=13.5 inches and a diameter D=7 inches wherein the dimensions L2, and D are identified in FIG. 20. By way of comparison, a single cylindrical cavity filter of the prior art would have approximate dimensions, namely, an axial length of 4.5 inches and a diameter of 7 inches, this being approximately the same diameter as the diameter of an entire diplexer of the present invention. In an L-band phased array antenna operating at 1.5 GHz, the radiating elements of the feed, such as the radiating elements 228 of FIG. 21, would be spaced apart on centers by approximately 8 inches in a typical situation, it being recognized that the spacing may be varied from the foregoing amount to meet specific antenna requirements. The present diplexer is, therefore, able to be placed in the space directly behind a radiating element as is disclosed in FIG. 21. But, in the case of the prior art, a single filter, of which several such filters might be used in the construction of a diplexer, occupies as much space across a transverse plane of the feed as does a complete diplexer of the invention. Therefore, the invention enables a construction of diplexer and of a phased array antenna employing such diplexers which have not been available heretofore.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A microwave filter assembly having at least one cavity, said at least one cavity comprising:

a first end wall and a second end wall, and a section of waveguide disposed between and connecting with said first and said second end walls, said waveguide section extending along a longitudinal axis of said one cavity from said first end wall to said second end wall, said waveguide section having an outer wall encircling said axis;

a ridge extending from said outer wall inwardly toward a central region of said waveguide section;

means in at least one of said walls for coupling electromagnetic energy into said one cavity, wherein a cross-section of said one cavity, in a plane perpendicular to said axis, has a shape approximating a semicircle, and wherein a portion of said outer wall is a planar wall segment disposed along a diameter of the semicircle, and a second cavity, said one cavity being a part of a first filter and said second cavity being part of a second filter, said second cavity having a configuration similar to a configuration of said one cavity and including a planar wall segment and a ridge extending from a wall of said second cavity toward a central region of a waveguide section of said second cavity, wherein said first filter and said second filter are interconnected to provide the function of a diplexer, the planar wall segment of said second cavity being contiguous the planar wall segment of said one cavity to provide a generally circular configuration to said diplexer, and wherein a lower-frequency cut-off of each of said cavities is reduced by the presence of said ridge in each of said cavities, thereby permitting a reduction in size of said diplexer relative to the size of a diplexer operative at a common frequency band but employing non-ridged cavities.

2. A microwave filter assembly having at least one cavity, said at least one cavity comprising:

a first end wall and a second end wall, and a section of waveguide disposed between and connecting with said first and said second end walls, said waveguide section extending along a longitudinal axis of said one cavity from said first end wall to said second end wall, said waveguide section having an outer wall encircling said axis;

a ridge extending from said outer wall inwardly toward a central region of said waveguide section; and means in at least one of said walls for coupling electromagnetic energy into said one cavity, wherein a cross-section of said one cavity, in a plane perpendicular to said axis, has a shape approximating a semicircle, and wherein a portion of said outer wall is a planar wall segment disposed along a diameter of the semicircle.

3. A filter assembly according to claim 2 wherein said first end wall is an iris plate having at least one iris, said one iris serving as said means for coupling electromagnetic energy to said one cavity.

4. A filter assembly according to claim 3 further comprising a second waveguide section and a third end wall, said second waveguide section extending from said second end wall to said third end wall to form with said second end wall and said third end wall a second cavity, said second cavity including a ridge extending inwardly from said outer wall toward a central region of said second waveguide section, and wherein said second wall is an iris plate having at least one iris for coupling electromagnetic power between a mode of resonance within said one cavity and a mode of resonance within said second cavity.

5. A microwave filter assembly having at least one cavity, said at least one cavity comprising:

a first end wall and a second end wall, and a section of waveguide disposed between and connecting with said first and said second end walls, said waveguide section extending along a longitudinal axis of said one cavity from said first end wall to said second end wall, said waveguide section having an outer wall encircling said axis;

a ridge extending from said outer wall inwardly toward a central region of said waveguide section;

means in at least one of said walls for coupling electromagnetic energy into said one cavity, wherein said ridge is a first ridge, and has at least a first component which extends inwardly from said outer wall in a plane parallel to said axis; and a second ridge within said waveguide section of said one cavity, said second ridge having at least a first component which extends inwardly from said outer wall in said plane parallel to said axis, wherein each of said ridges comprises a second component configured as a capacitor plate, and wherein in each of said ridges, said capacitor plate is disposed on a inner end of said first component, the capacitor plate of said first ridge being parallel to the capacitor plate of said second ridge.

6. A filter assembly according to claim 5 wherein the first component of said first ridge is coplanar with the first component of said second ridge.

7. A filter assembly according to claim 5 wherein a region between said capacitor plates supports a first mode of resonance of electromagnetic waves wherein an electric field is parallel to said plates, and a second mode of resonance of electromagnetic waves wherein an electric field is perpendicular to said capacitor plates.

8. A filter assembly according to claim 7 wherein said coupling means is located in said first end wall.

9. A filter assembly according to claim 8 wherein said coupling means is operative with only one of said modes of resonance.

10. A filter assembly according to claim 9 further comprising a second waveguide section and a third end wall, said second waveguide section extending from said second end wall to said third end wall to form with said second end wall and said third end wall a second cavity, said second cavity having a first ridge and a second ridge with configurations substantially the same as the configuration of said first ridge and said second ridge of said one cavity, and wherein said filter assembly further comprises a second coupling means disposed in said second end wall for coupling electromagnetic power between one of the modes of said first cavity and a mode of said second cavity.

11. A feed for a phased array antenna comprising:

an array of radiating elements, an array of diplexers coupled to respective ones of the radiating elements, and a housing supporting the diplexers behind the radiating elements;

wherein each of said diplexers comprises two microwave filter assemblies, each of the filter assemblies having at least one cavity, said at least one cavity comprising:

a first end wall and a second end wall, and a section of waveguide disposed between and connecting with said first and said second end walls, said waveguide section extending along a longitudinal axis of said one cavity from said first end wall to said second end wall, said waveguide section having an outer wall encircling said axis;

a ridge extending from one of said walls inwardly toward a central region of said waveguide section; and means in at least one of said walls for coupling electromagnetic energy into said one cavity; and wherein in each cavity of each of said diplexers, the cavity has an approximate right semicircular cylindrical shape including a substantially planar wall surface;

in each of said diplexers, said at least one cavity in one of said filter assemblies is mounted back to back with a corresponding cavity in the second of said filter assemblies to provide a substantially right circular cylindrical shapes to the diplexer, the ridge in each of said cavities reducing the frequency of a resonant frequency of the cavity resulting in a diameter of diplexer which is less than a diameter of the corresponding radiating element.

* * * * *